United States Patent [19]

Bulla

[11] 4,195,388

[45] Apr. 1, 1980

[54] CAN CREELS FOR FEEDING FIBRE SLIVERS TO TEXTILE MACHINES

[76] Inventor: Beatrice Bulla, Via la Campagna, Serocca d'Agno, Switzerland

[21] Appl. No.: 832,360

[22] Filed: Sep. 12, 1977

[30] Foreign Application Priority Data

Jan. 27, 1977 [IT] Italy ..... 19702 A/77

[51] Int. Cl.[2] ..... D01G 23/00

[52] U.S. Cl. ..... 19/157

[58] Field of Search ..... 19/157, 159 R, 151, 19/240; 226/10, 11, 36

[56] References Cited

U.S. PATENT DOCUMENTS

| | | | |
|---|---|---|---|
| 1,626,954 | 5/1927 | Naumburg | 19/157 |
| 2,608,725 | 9/1952 | Strew | 19/157 |
| 3,371,388 | 3/1968 | Dilles | 19/151 |

FOREIGN PATENT DOCUMENTS

| | | | |
|---|---|---|---|
| 2230644 | 12/1972 | Fed. Rep. of Germany | 19/157 |
| 41-2739 | 2/1966 | Japan | 19/157 |
| 42-14134 | 8/1967 | Japan | 19/157 |
| 43-16913 | 7/1968 | Japan | 19/240 |
| 135792 | 2/1960 | U.S.S.R. | 19/157 |
| 212798 | 10/1968 | U.S.S.R. | 19/157 |

*Primary Examiner*—Dorsey Newton

*Attorney, Agent, or Firm*—Lon H. Romanski

[57] ABSTRACT

An improvement in and to can creels for feeding fibre slivers to textile machines, wherein one or more reserve slivers are provided for and advanced when one or more of the normally fed fibre slivers are broken or run-out. A pair of feeding rollers automatically controls the advancement and the positioning of each reserve sliver in order to substantially maintain a feeding continuity between the broken or run-out normal sliver and the reserve sliver and between such reserve sliver and a newly introduced normal sliver.

17 Claims, 12 Drawing Figures

CAN CREELS FOR FEEDING FIBRE SLIVERS TO TEXTILE MACHINES

BACKGROUND OF THE INVENTION

1. Field of the Invention

This invention relates to improved can creels for feeding fibre slivers to textile machines.

In the textile industry such can creels are well known and used to take a plurality of fibre slivers or rovings out from their collecting cans and convey the same along substantially parallel feeding paths, toward the creel outlet, wherefrom said slivers are fed to the inlet of textile machine in order to be then processed by the same machine, which may be e.g. a comber, a mixer, a grill box, and so on.

2. Description of the Prior Art

In the known can creels the problem of accidental breaking of slivers, taken out from their cans and fed by the creel to the textile machine, results in heavy drawbacks, and namely above all in the necessity of stopping the whole equipment to re-establish the continuity of broken slivers; the same holds for the problem originating from the exhaustion of slivers. Such problems were heretefore solved in a complex manner, by the provision of a further can, containing a so called reserve sliver and coupled to each can containing the normally fed sliver, said reserve sliver being taken out by the creel when the normaly fed sliver is broken or exhausted. Such solution implies a great number of complex and expensive means.

SUMMARY OF THE INVENTION

An object of this invention is to solve the above problems in a simple and satisfactory manner. Accordingly, it consists in an improvement in and to can creels for feeding fibre slivers to textile machines, and comprising a plurality of cans, each of which containing one or more fibre slivers that are individually and mechanically taken out from the can and conveyed, along with the slivers of all other cans, toward the textile machine, so that a plurality of slivers are fed along substantially parallel paths, said improvement consisting in that at least one reserve sliver is placed with its fore end near the creel front end and is retained therein by a pair of feeding rollers, which are kept still when the creel is normally operating and are driven when a sliver is broken or run-out in order to feed said reserve sliver toward the plurality of normal slivers, in substitution of the broken or exhausted sliver, said feeding roller being started with a suitable delay with reference to the instant in which a breakage or exhaustion of a normally fed sliver occurs, in order to obtain a controlled overlap of the reserve sliver fore end onto the back end of broken or run-out sliver.

DESCRIPTION OF THE PREFERRED EMBODIMENTS

Figure 1:
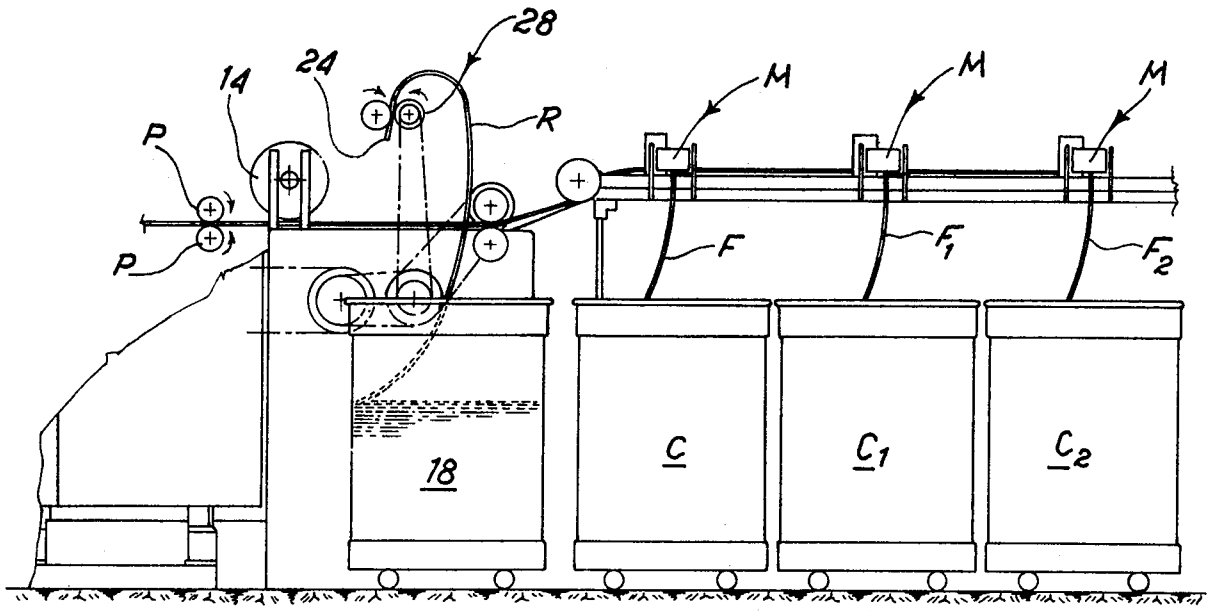
FIG. 1 is a diagrammatic side view of an improved creel according to this invention.

Referring to the drawings, a creel comprises a plurality of cans, containing textile fibre slivers and arranged in two side rows, namely the cans B, B1,B2, and the cans C, C1,C2, containing the normal or active slivers D, D1,D2 and F, F1,F2 respectively. Said slivers are unwound by a well known creel action and thus taken out from their cans, each sliver being pressed by a pair of pressure rollers M, and then guided along a path parallel to the machine longitudinal axis, so to form a row N of parallel slivers—six slivers in the considered case, wherein six cans, containing the slivers to be fed are provided for. The slivers are pulled in the direction of arrow X by dragging rollers P, which motion is taken from the machine main control. Said sliver row N, which is transferred from an upper supporting plane 10 to a lower supporting plane 12, is processed by an accompanyingor conveyor roller 14 exerting a required homogenizing pressure onto the fibres of said sliver row.

The row N is then conveyed to a textile machine, that may be a comber, a mixer, a gill box, and so on.

Near the creel fore end one or more reserve slivers are placed, namely in the considered example two reserve slivers Q and R are respectively contained in cans 20 and 18 located on the creel side and occupying the first or downstream positions with reference to the sliver feeding direction. The fore ends 24 of said reserve slivers Q and R are retained by pairs of driven rollers 26 and 28, respectively, that can be alternately or simultaneously started by the engagement of related clutches, that are controlled in a manner which will be explained later on.

The performances and the operation of the improved creel according to the invention will be apparent and are summarized as follows. During the normal creel operation, the sliver row N, made-up by six parallel single slivers D, D1 and D2, and F, F1, F2 is pulled under a given tension by dragging rollers P, that advance the row toward the textile machine, where the slivers will be submitted to a further processing. During such creel normal operation, the driven rollers 26,28, acting on reserve slivers Q an R, are kept still and hold the fore ends 24 of said slivers above the row N.

Assuming now that e.g., due to any reason, the sliver F2 gets broken or run-out, the reserve sliver R will intervene for keeping unaltered the features of sliver row N and thus the yarn count. Actually, the rollers 28 are started by the engagement of clutch 32 (FIG. 1), with a given delay in respect of the moment wherein the sliver F2 gets broken or run-out, such delay corresponding to/the time taken by the broken or run-out sliver rear end to attain a point of plane 12 underlying the fore end 24 of reserve sliver R. Such roller turning results in a drawing of the reserve sliver R out of can 18, and in a laying thereof down onto the row N with a given overlapping to the rear end of broken sliver F2 and therefore in a restoring of the continuity of row N, in the same way as if no breaking or running-out of sliver F2 did occur.

Obviously, the speed of rollers 28 is to be synchronized with that of all other driven rollers, in order to prevent any relative sliding between the various fibres of the restored silver row N.

Such condition is maintained until the sliver F2 is replaced, or the end of the broken sliver is reinserted. Then the feed of reserve sliver R is stopped when the fore end of sliver F2 has attained the overlapping point with the sliver R within the row N.

To exclude the reserve sliver R, once the normal sliver F2 is stuck again, a control is actuated by the operator, after the fore end of the re-inserted feed sliver is passed by a given length over the meeting point of the reserve sliver. By such a control, the pair of rollers 28 are stopped and the reserve sliver is torn-off by the pull as exerted by the rollers P, or is cut-off as by a usual sliver-cutter, The fore or leading end 24 of the reserve sliver R is then retained between the rollers 28, and it is thus ready to be further advanced when one of slivers F, F1,F2 gets broken or when anyone of such slivers gets run-out.

A control signal for starting the rollers 28 and rollers 26 is imparted when a pair of pressure rollers M are brought into mutual contact due to interruption of normal sliver F, as they/are no longer maintained spaced from each other by the sliver running therebetween.

Obviously, when the sliver $F_1$ or $F_2$ is broken or run-out, the same sliver substitution procedure as above described is repeated, with the only difference of a change in the delay or time lag of intervention of rollers 28, since such delay must be obviously as longer as greater is the distance of the broken or run-out sliver rear end from the zone underlying the rollers 26–28. Similary, when anyone of slivers D,D1,D2 of the other row is broken or gets run-out, the whole procedure as above described is repeated, except for the intervention of clutch 30 and driven rollers 26 to draw the reserve sliver Q for replacing the broken or run-out sliver.

Obviously, a simultaneous intervention of rollers 26 and 28 can occur when a simultaneous breaking or running-out of two slivers pertaining to row D and respectively to row F takes place.

Instead of having two cans 20–18, and thus two reserve slivers Q and R only, further cans and thus further reserve slivers, directed toward related pairs of draw-in rollers, may be provided for.

From what precedes it is apparent that the improvement according to the invention allows to obtain properly established splicings between the tail or tailing ends of broken or run-out slivers and the fore ends of reserve slivers, as well as between the tail ends of said reserve slivers and the fore ends of further normal feed slivers, substituted for the run-out slivers.

When a sliver of creel is broken or run-out and no reserve sliver is available, the machine is automatically stopped due to the simultaneous contact between the cylinders M and shaft 155 and respectively between the driven rollers of each pair 26–28. By such simultaneous contact, the breaking of an electric circuit and a consequent machine stopping is caused. When a reserve sliver is run-out while being drawn-in, the operator is alerted by an acoustic and/or optic alarm signal.

The insertion of a new reserve sliver may be made manually, by introducing its fore or leading end between the pair of driven rollers 26 or 28, or it may made by means of a suitable inserting device (not shown).

The improvement according to this invention can be embodied in already existing creels by simple and unexpensive changes and adaptations.

The same improvement can be utilized even when the sliver or slivers, either or both the normally fed and the reserve slivers, instead of being taken out from cans, are unwound from packages or bobbins.

Figure 3:
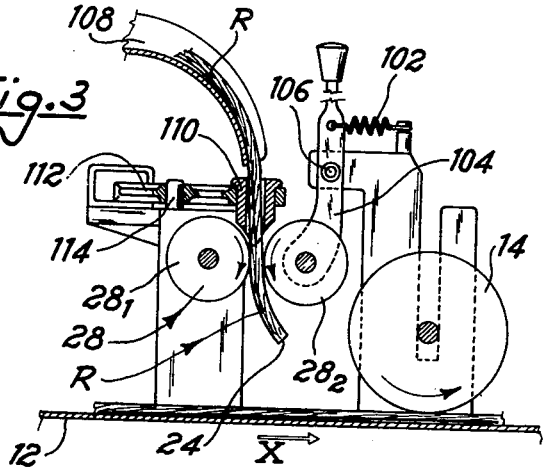
FIG. 3 is a side view of a creel portion comprising a pair of rollers for feeding the reserve sliver, along with suitable guide means to properly position said reserve sliver in respect of the normally fed slivers.
Figure 4:
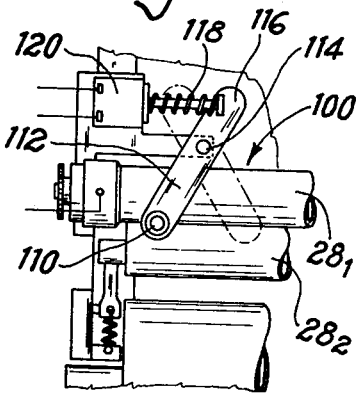
FIG. 4 is a plan view of the detail as shown in FIG. 3.
Figure 5:
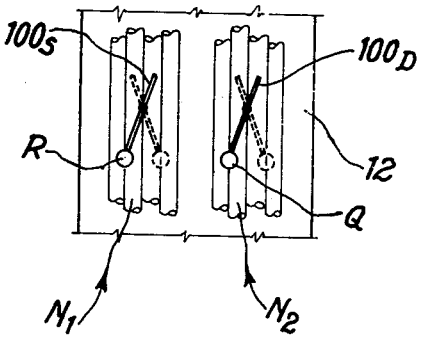
FIG. 5 is a diagrammatic view similar to that of FIG. 4, and showing a pair of guide means for positioning the reserve sliver in correspondence of related sliver rows.

Referring now to FIGS. 3 to 5, guide and positioning means 100, by which the reserve sliver R is laid down onto the tail end of a run-out of a run-out or broken sliver of left row of slivers N taken out of cans will be described, such means 100 being in the form of a pair of draw-in rollers and namely the pair of rollers 28, formed by a driving roller $28_1$, and a driven or loose fitted roller $28_2$.

The sliver accompanying roller is shown by the reference 14 while 12 is the supporting table of the advancing fibres; the directions of rotation corresponding to the sliver advancement in the direction X, are shown by related arrows.

The driven roller $28_2$ is resiliently urged against the roller $28_1$ by a spring 102, that urges an arm 104 to turn about a pin 106.

A conveyor 108 guides the reserve sliver R before its introduction into a shaped throat 110, supported by a lever 112 pivotally fitted on a pin 114 having an axis perpendicular to the parallel axes of rollers $28_1$, $28_2$ and stationarily mounted in respect of the machine frame. The opposite end 116 of said lever 112 is acted upon by a resilient means 118, which tends to keep the lever 112 turned in the position as shown by solid lines in FIG. 4. The end 116 of lever 112 is pivotally connected with one end of the movable armature of an electromagnet 120 that can be energized or de-energized as a function of what occurs in the related normal sliver row N that is being processed; the energization of electromagnet 120 results in an attraction of the armature to the left (see FIG. 4) against the action of spring 118, and thus in an anticlockwise rotation of lever 112 until reaching the position shown by dash lines in FIG. 4.

As already stated, said means 100 operate in order to accurately lay the related reserve sliver R down onto the normally fed broken or run-out sliver F-D, which has become missing in the composition of the related row. In the considered creel, since there are two sliver rows, there will be obviously two devices 100.

If the device 100 is not utilized, when the broken or run-out normal sliver is not by chance exactly below the reserve sliver which is drawn-in for the substitution, an overlapping of slivers and thus an alteration of row structure should occur. Said device 100, has a throat 110 that in the considered case can be brought in two positions only but that may take more than two positions in other cases. When the electromagnet 120 is de-energized, the reserve sliver position exactly corresponds to that of left slivers of row $N_1$ (see FIG. 5) and thus, when the roller $28_1$ is started, the reserve sliver R will be drawn-in along its left path, thereby replacing the interrupted normal left sliver. When instead the electromagnet 120 is energized, the armature is moved to the left, and the lever 112 is turned to the right so that the throat 110 takes the position as shown by dash lines and thus a right position, corresponding to the right path of normal slivers, is taken by the reserve sliver R. In such a position, when one of slivers in the right row is missing, it is exactly replaced by the reserve sliver. Obviously, the intervention of device 100 depends by the machine operating conditions and in particular the control of electromagnet 120 is responsive to path conditions of the sliver to be replaced. As specifically shown in FIG. 5*a*, left device $100_s$ and a right device $100_D$ are provided for, the former device controlling the reserve sliver R, whilst the latter device controls the reserve sliver Q.

Figure 6:
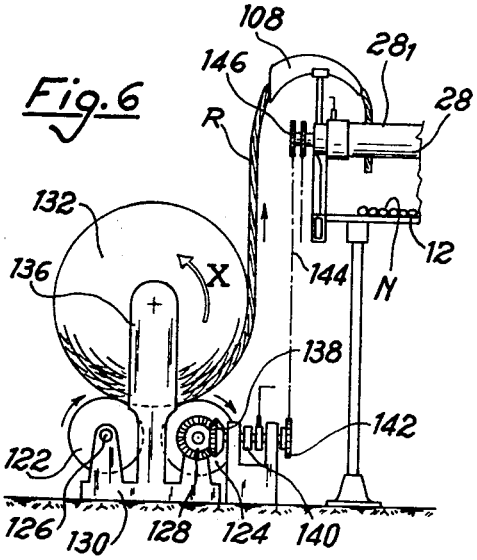
FIG. 6 is a side view showing the arrangement of a reserve sliver package, laid onto unwinding rollers.

FIG. 6 shows that the reserve sliver R, instead of being taken out from a can 18, may be unwound from a bobbin 132 resting on a pair of rotary rollers 122–124, which axes 126–128 are supported on a bed plate. Said bobbin 132 is kept in a lateral position by a separator 136. The roller 124 is driven by a gear 138, keyed on a shaft which is controlled by an electromagnetic clutch 140 that is in turn controlled by a pinion 142, whose continuous motion is derived from the machine main drive through a transmission chain 144 acted upon by a pinion 146 connected to the driven roller $28_1$ appertaining to the roller pair 28 by which the reserve sliver R is drawn-in. When the electromagnetic clutch 140 is energized simultaneously with the starting of rollers 28(with a suitable delay in respect of the moment in which the normal sliver to be replaced is broken or run-out), the gear of roller 124 is started in the direction of the marked arrow, and therefore the bobbin 132 is turned in the direction of arrow X, thereby causing the other roller 122 to turn. The turning of bobbin 132 allows an unwinding of sliver R, which is thus advanced and inserted into the related row of normal slivers. When the continuity of normal sliver is restored, the rollers 28 are obviously stopped, as previously stated, together with the roller 124, due to the de-energization of electromagnet 140.

Figure 2:
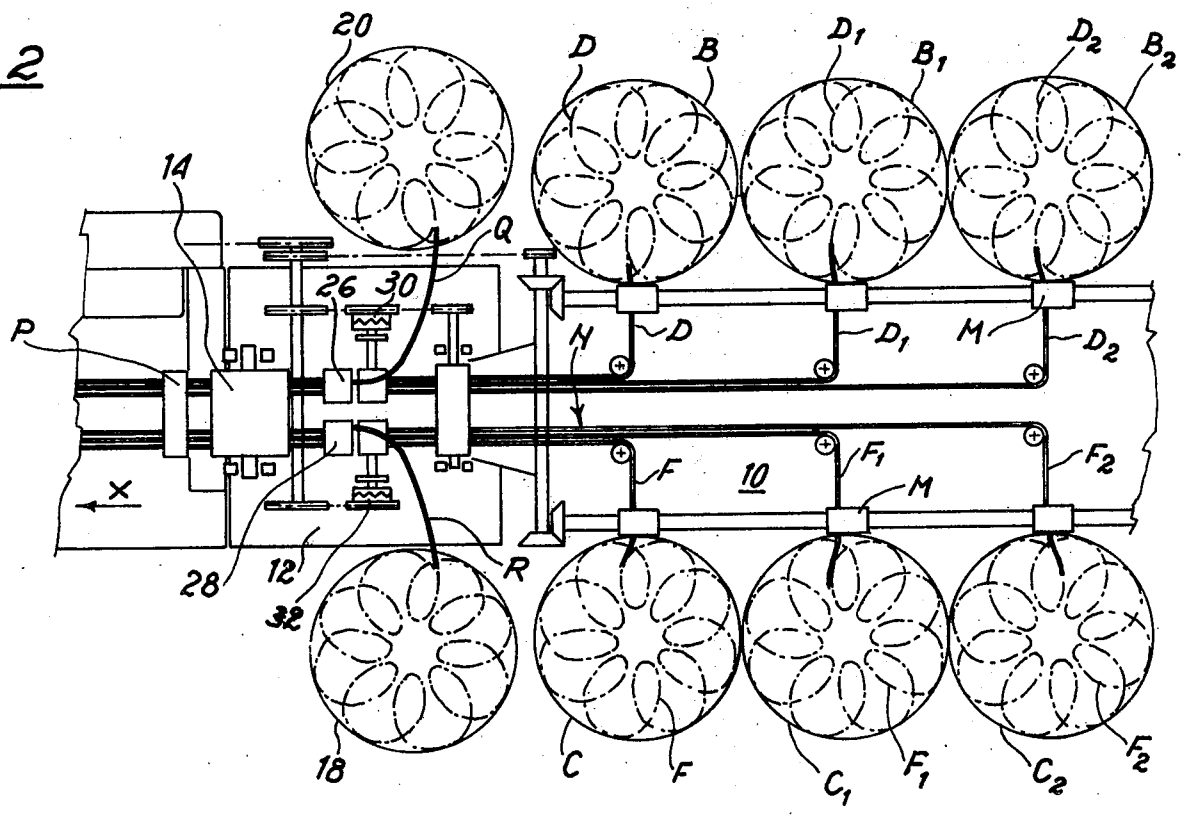
FIG. 2 is a diagrammatic plan view of creel of FIG. 1.
Figure 8:
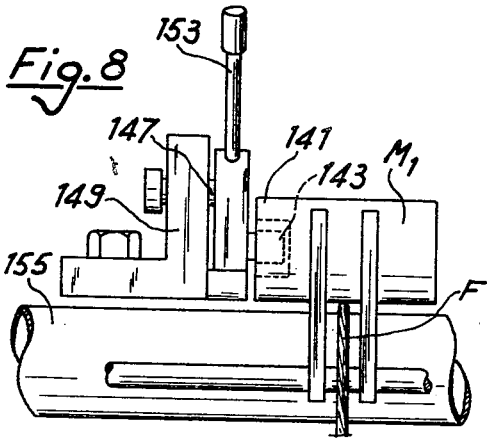
FIG. 8 is a front view of the same detail of FIG. 7, in a plane perpendicular to that of said FIG. 7.
Figure 7:
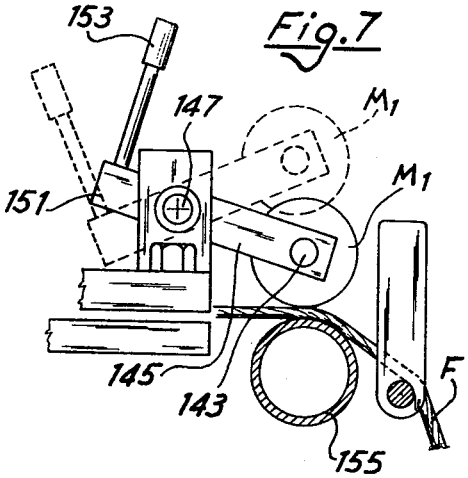
FIG. 7 is a side view showing a counterweighed pressure roller for feedig a normal sliver.

Referring now to FIGS. 7 and 8, they show a pressure roller means M (also see FIGS. 1, 2 and 3), by which a normal sliver F-D is acted upon, as comprising a pressure roller $M_1$ that is counterweighed in such a manner as to always ensure the attainment of a lowered position down onto the shaft 155, when a normal sliver for D is inserted.

Actually, said roller M, is revolvingly fitted with its end 141, on an axis 143 fastened to a lever 145, which is in turn pivotally fitted on a pivot 147 that extends parallel to the axis 143, and is mounted on an angle iron 149, which is in turn secured to the creel frame; the end 151 of said lever 145, opposite to that whereon the axis 143 is supported, is fitted with a handle 153, so that said lever 145 can be turned by the operator in an anticlockwise direction, when the roller $M_1$ is to be lifted.

When the roller $M_1$ is to be lifted for inserting the fore or leading end of sliver F, a downward thrust is exerted by the operator on the handle 153, whereby the lever 145 is turned in anticlockwise direction, until attaining the position as shown is dash lines in FIG. 7 and lifting the roller $M_1$ from the driven shaft by which the normal sliver F is advanced; when the sliver is inserted between the shaft 155 and roller $M_1$, the handle 153 is left free by the operator and the suitably counterweighed lever 145 is brought down to its lower position, whereby the sliver F is nipped between said roller and said shaft, and will thus be advanced in the manner as previously described.

When the sliver F is missing, the lifting of roller $M_1$ and the removal thereof from shaft 155, will coincide with the transmission of a signal for locking the rollers by which the reserve sliver is drawn-in, said locking getting after a pre-established time from the insertion of a new sliver below the roller $M_1$, in order that the splicing of reserve sliver and normal sliver should occur in a controlled way, without too much overlapping or disjunction. Moreover, since the roller $M_1$ is safely lowered directly after the fore or leading end of a new normal sliver is inserted by the operator, the possibility that too great lenghts of normal sliver be fed, with consequent possibility to form irregular splicings, is positively prevented. It is also avoided the possibility that, due to an inadvertence or oversight by the operator, the roller $M_1$ be left lifted, whereby one less sliver is fed.

Figure 9:
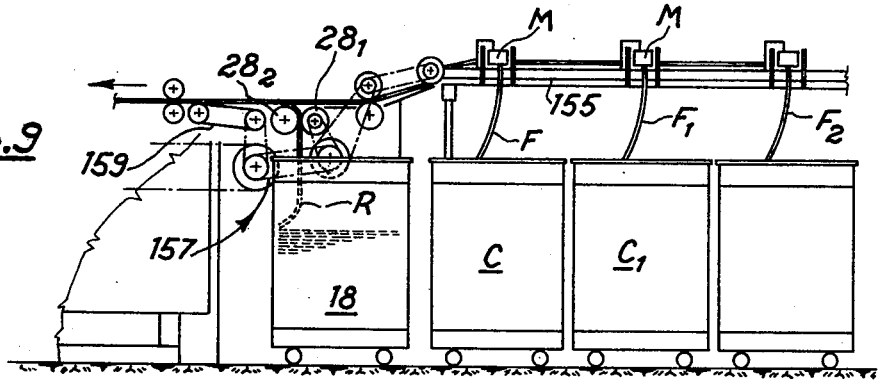
FIG. 9 is a view similar to that of FIG. 1, but wherein the reserve slivers are fed below the normal sliver feeding plane.
Figure 10:
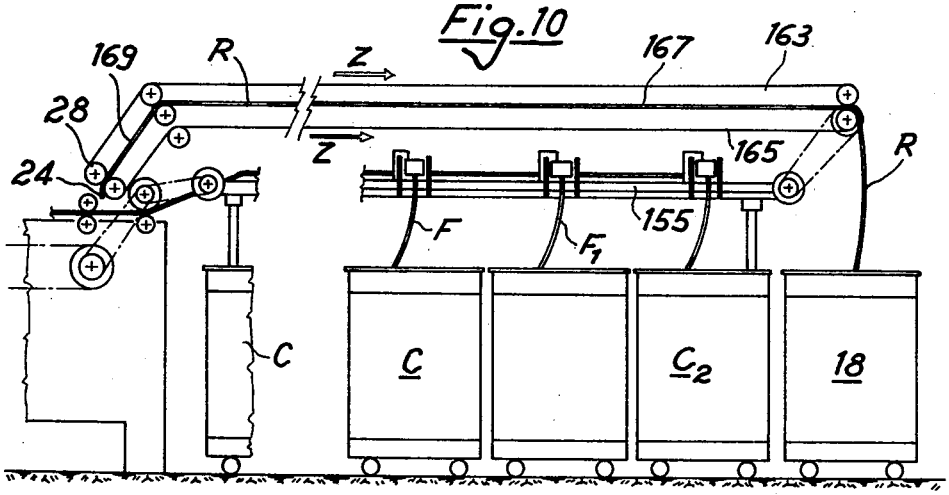
FIG. 10 is a view similar to that of FIG. 9, wherein the reserve sliver is taken in a point behind the creel and pulled by suitable means to/the creel fore end.

FIGS. 9 and 10 respectively show the feeding system of reserve slivers R-Q from below (the left sliver R only being shown) and a guide and conveying system of reserve slivers R-Q, located rearwardly of normal slivers, by endless conveyor means.

Referring to FIG. 9, the pair of rollers 28, i.e., the driven roller $28_1$, and the loose fitted roller $28_2$, are located below the sliver advancing plane; obviously, the fore or leading ends of reserve slivers are inserted in the row of normal slivers, when needed, always at the creel fore end.

The shown arrangement of said draw-in rollers 28, which involves a different structure of mechanisms, does not result in a different equipment operation. Actually, to bring the reserve slivers onto the normal sliver advancing plane, an auxiliary device is foreseen which comprises a back gear 157 adapted to drive an endless conveyor belt 159, whereon the fore ends 24 of reserve slivers, coming from rollers 28, are laid; such slivers are then advanced along the advancing plane together with all other normal slivers, without danger of falling down.

In the embodiment of FIG. 10, the reserve slivers R-Q are contained in cans 18, located behind cans C wherefrom the normal slivers F are taken out. To allow for a better conveying of reserve slivers toward the creel fore portion where the reserve slivers fore ends 24 are to be inserted, when required, in the related row of normal slivers, suitably located endless conveyor belts 163 and 165 are foresen, having reserve sliver conveying lengths movable toward said creel fore portion, while the conveyor return lengths run in the opposite direction, as indicated by the arrows Z. Actually, the reserve sliver R or Q is continuously guided between said endless belts, which firstly run along a horizontal path 167 and then along a downwardly inclined path 169, at the end of which the draw-in rollers 28 are located above the sliver row advancing plane. In order to convey the reserve slivers from the machine rear side to meeting point, in the considered case two pairs of endless conveyor belts are driven by independent controls, similar to those of cylinders 28; the endless belts may be substituted with equivalent means, e.g. chain conveyors or the like.

Figure 11:
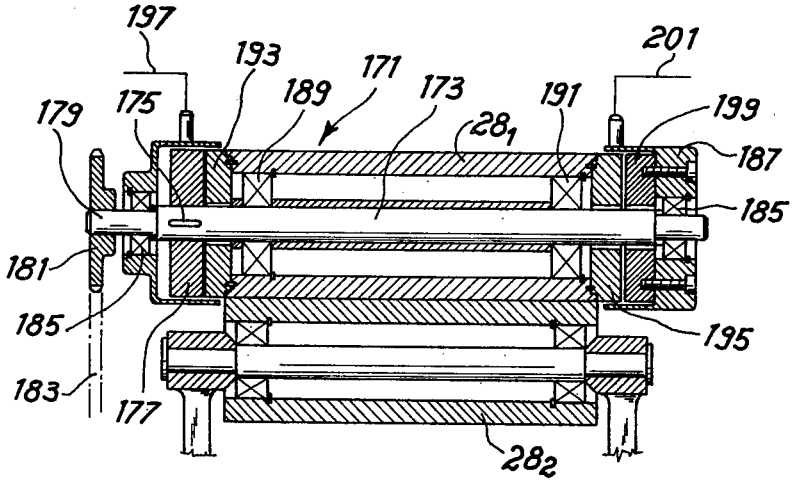
FIG. 11 is a cross-sectional view showing an electromagnetic clutch device for controlling the driven roller of the reserve sliver feeding roller pair and for tearing off the same reserve sliver after the or active sliver is reinstated.

FIG. 11 shows an electromagnetic clutch device 171, for controlling the driven roller $28_1$ of the reserve sliver draw-in roller pair. Said device 171 comprises a shaft 173, fastened by a key 175 to a cylindric ring 177; the end 179 of said shaft 173 is keyed to a gear 181 in mesh with a chain 183, which is driven by the creel main drive, where-by said gear 181 is caused to continuously turn, along with the shaft 173, that is mounted on bearings 185 having outer shells secured to the machine frame 187.

The roller $28_1$ is supported by the shaft 173 through bearings (89 and 19) which inner shells are secured to the same shaft, while their outer shells are secured to the roller $28_1$. Fast with the ends of this roller are ferromagnetic rings 193–177, that extend perpendicularly to the shaft 173. The ferromagnetic ring 193 is adjacent to the ferromagnetic ring 177, that appertains to an electromagnet connected as in 197 with an electric generator and the ferromagnetic ring 195 is adjacent to a fixed ferromagnetic ring 199, that appertains to an other electromagnet, connected as in 201 with the same electric generator.

Obviously, the driven roller $28_1$ is in contact with the loosely fitted roller $28_2$ along one of the roller generatrices.

It will be now apparent that, under normal creel operating conditions, i.e., when the slivers D-F are fed toward the textile machine along the plane 12, the shaft 173 is turning, while the roller $28_1$ is kept stopped, along with the roller $28_2$, since the electromagnet 201 is energized and thus the ring 195 is attracted by the ring 199 which is permanently locked to the machine frame and keep locked also said ring 195 and thus the roller $28_1$. Since the electromagnet 201 is energized, the electromagnet 197 is de-energized.

When at least one normal sliver is broken or run-out, and therefore the intervention of reserve slivers drawn-in by the rollers 28 is required, the electromagnet 197 is automatically energized and the electromagnet 201 is de-energized. Consequently, the ring 193 is attracted by the ring 177, while the ring 195 is unlocked from the ring 199. Accordingly the driving shaft 173 and the roller $28_1$ are locked with one another through the torsional coupling 177–193. Now, the rotary motion of shaft 173 is directly transmitted to the roller $28_1$ which, along with its mating roller $28_2$, draws-in the reserve sliver. Once the intervention of rollers 28 is no more needed, since the continuity of normal slivers is re-established, the electromagnet 197 is de-energized and the electromagnet 201 is energized, whereby the connection 177–193 is broken and the ring 193 is no more attracted by the ring 177, while the connection 199–195 is re-established, i.e., the ring 199 is attracted by the ring 199 to stop and lock the roller $28_1$ Strictly speaking, the electromagnet 201 would not be indispensable, but it is suitable in order to brake the rotational inertia of roller $28_1$ and to lock the same as soon as the components 177 and 193 are separated, thereby causing the reserve sliver to be torn off.

Figure 12A:
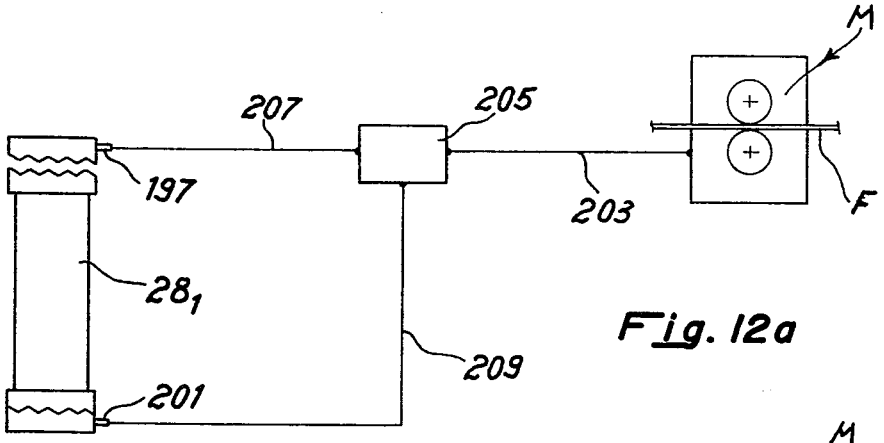
FIG. 12*a*, FIG. 12*b* and FIG. 12*c* are diagrams showing the circuit for controlling the pulses that are imparted to the rollers pulling the reserve slivers.
Figure 12B:
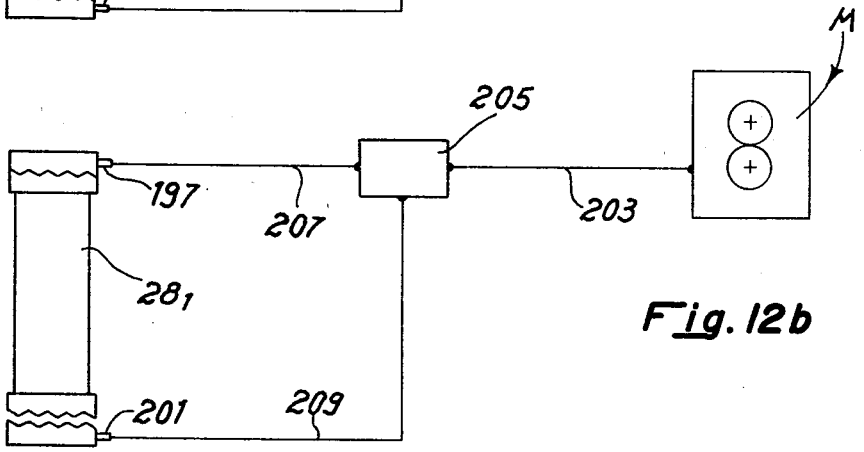
Figure 12C:
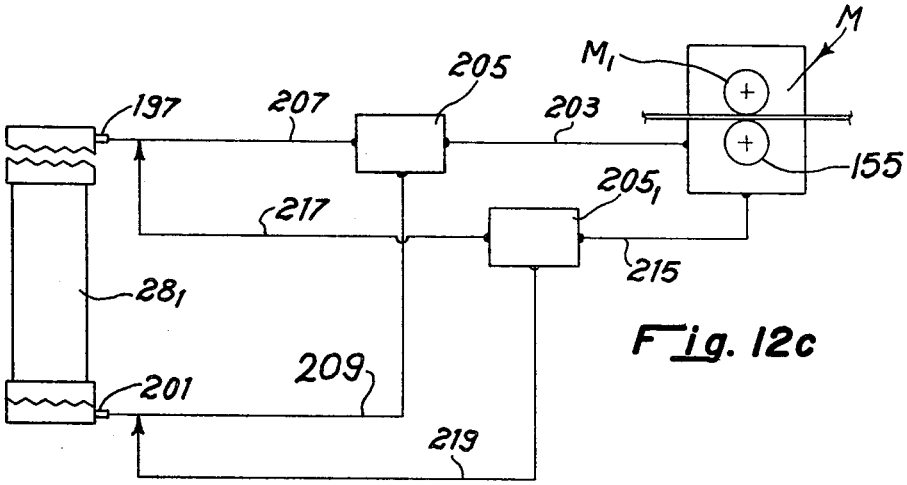

As shown in each of FIGS. 12*a*, 12*b* and 12*c*, from the pairs of pressure rollers M, a circuit 203, passes through a timer 205 and is then branched in two circuits 207 and 209, respectively connected with the electromagnet 197 and with the electromagnet 201. Under the condition as shown in FIG. 12*a*, i.e., when the normal sliver F is advancing between the pressure rollers, the electromagnet 201 is energized and thus the roller $28_1$ is kept locked, whilst the electromagnet 197 is de-energized.

As shown in FIG. 12*b* when no sliver F is present under the rollers M, the signal of such missing presence, due to the contact of said rollers, is delayed by the timer 205, and then forwarded with a given time lag through the circuits 207–209 toward the related electromagnets 197 and 201, whereby the electromagnet 197 is energized after a given time from the breaking or running-out of normal sliver. When such a condition occurs, the roller $28_1$ is started after said pre-established time lag and draws-in the reserve sliver, already nipped between the rollers 28, just when the rear end of broken or run-out normal sliver has reached the fore end 24 of reserve sliver.

In FIG. 12*c* is shown an additional circuit 215, starting from rollers M and reaching a second timer $205_1$, where from two circuits 217 and 219 are directed toward the electromagnets 197 and 201, respectively. When the fore end of a new normal sliver is placed between the rollers M, the circuits 203,207,209 are kept inactive, while the signal which is transmitted as soon as the roller $M_1$ is lifted, due to missing contact with the component 155, is forwarded through the circuit 215 and reaches the timer $205_1$, where it is suitably delayed, to be then forwarded through the circuits 217 and 219, toward the electromagnets 197–201, thereby energizing the electromagnet 201 and thus locking the rollers 28.

It is to be understood that many changes may be made in the construction details and arrangements of the shown improved creel.

I claim:

1. A sliver feeding arrangement for simultaneoulsy feeding a plurality of moving active slivers to related textile machine means, comprising a plurality of first sources for providing a plurality of said active slivers, each of said first sources providing at least one active sliver, means for guiding each of said plurality of active slivers in their movement in predetermined paths so that said active slivers during at least a portion of said paths are moving generally parallel to each other, means for operatively engaging said active slivers as to draw said active slivers from said first sources, move said active slivers along said paths and feed said active slivers toward said textile machine/means, a second source for providing a reserve sliver, at least a pair of feed rollers, support means supporting said pair of feed rollers as to maintain said feed rollers generally transverse to and in spaced relationship to said active slivers moving through said portion of said paths, said feed rollers maintaining a leading portion of said reserve sliver therebetween, drive means operatively connected to said feed rollers and effective to at times drive said feed rollers as to thereby feed said reserve sliver therebetween, detecting means effective to detect the existance of each of said plurality of said active slivers and being further effective to detect the occurrence of a break or run-out in any of said plurality of said active slivers, upon detecting a said occurence of a break or run-out said detecting means also being effective for causing the occurrence of an electrical output signal for application to and consequent energization of said drive means to cause energization of said feed rollers to thereby cause feeding of said reserve sliver to thereby replace the detected broken or run-out sliver, and time delay means effective for delaying the said energization of said feed rollers until after the expiration of a preselected interval of time subsequent to said means detecting the said occurence of a break or run-out, said time delay means and said preselected interval of time being thereby effective to provide for a selected degree of overlapping as between the said leading portion of said reserve sliver and a trailing portion of said detected broken or run-out active sliver.

2. A sliver feeding arrangement according to claim 1 wherein said feed rollers are effective for feeding said reserve sliver to the area of said portion of said paths where said active slivers are moving generally parallel to each other as to cause said overlapping to occur in said portion of said paths.

3. A sliver feeding arrangement according to claim 1 and further comprising guide means, said guide means being effective to move said leading portion of said reserve sliver generally transversely of and relative to said plurality of said active slivers as to thereby position said reserve sliver in a selected location at least generally corresponding to the relative location of said detected broken or run-out active sliver.

4. A sliver feeding arrangement according to claim 1 wherein said feed rollers are effective for feeding said reserve sliver to the area of said portion of said paths where said active slivers are moving generally parallel to each other as to cause said overlapping to occur in said portion of said paths, and further comprising guide means, said guide means being effective to move said leading portion of said reserve sliver generally transversely of and relative to said plurality of said active slivers as to thereby position said reserve sliver in a selected location at least generally corresponding to the relative location of said detected broken or run-out active sliver.

5. A sliver feeding arrangement according to claim 1 and further comprising means effective for braking said pair of feed rollers and thereby terminating the feeding of said reserve sliver therebetween.

6. A sliver feeding arrangement according to claim 5 wherein said means effective for braking is thusly effective for braking said pair of feed rollers only after the expiration of a preselected interval of time after said detected broken or run-out active sliver has been replaced by a replacement active sliver re-introduced into said feeding arrangement.

7. A sliver feeding arrangement according to claim 6 wherein said detecting means causes the occurrence of a second signal indicative of said re-introduction of said replacement active sliver, and wherein said second signal is applied to said means effective for braking said pair of feed rollers for causing said braking of said pair of feed rollers.

8. A sliver feeding arrangement according to claim 7 and further comprising second time delay means effective for delaying the application of said second signal to said means effective for braking said pair of feed rollers.

9. A sliver feeding arrangement according to claim 1 wherein said detecting means effective to detect the existance of each of said plurality of said active slivers comprises a plurality of detector means, wherein respective ones of said detector means are in operative engagement with respective ones of said plurality of said active slivers, and wherein each of said detector means comprises a translationally movable rotatable roller rollingly engaging a related respective one of said plurality of active slivers.

10. A sliver feeding arrangement according to claim 1 wherein said detecting means effective to detect the existance of said plurality of said active slivers comprises a plurality of detector means, wherein respective ones of said detector means are in operative engagement with respective ones of said plurality of said active slivers, and wherein each of said detector means comprises first and second roller means, wherein said first roller means is fixedly secured for rotation about a stationary axis of rotation, wherein said second roller means is rotatable about a translationally movable axis of rotation as to thereby be capable of translational movement toward and away from said first roller means, wherein said respective ones of said active slivers pass between said first and second roller means and in so doing keep said second roller means spaced from said first roller means, and wherein said second roller means automatically moves toward said first roller means upon said active sliver which was passing between said first and second roller means becoming broken or run-out.

11. A sliver feeding arrangement according to claim 10 and further comprising guide means, said guide means being effective to move said leading portion of said reserve sliver generally transversely of and relative to said plurality of said active slivers as to thereby position said reserve sliver in a selected location relative to said active slivers, said guide means being responsive to any of said plurality of detector means detecting the absence of a related active sliver, and said guide means being effective to move said reserve sliver to a second selected location which is reflective of and determined by the particular one of said detector means which has detected the said absence of a said related active sliver.

12. A sliver feeding arrangement according to claim 1 wherein said active slivers during said at least a portion of said paths are parallel and generally coplanar with each other.

13. A sliver feeding arrangement according to claim 12 wherein the plane of said coplanar active slivers is generally horizontally disposed, wherein said pair of feed rollers is situated at an elevation below that of said plane, and wherein said reserve sliver is fed upwardly toward said plane by said pair of feed rollers.

14. A sliver feeding arrangement according to claim 12 wherein said second source is distantly remotely situated with respect to said pair of feed rollers, and further comprising closed-loop endless type moving conveyor means for conveying said reserve sliver from said second source to said pair of feed rollers.

15. A sliver feeding arrangement according to claim 1 wherein said plurality of first sources comprise a plurality of first cans containing a supply of said slivers, wherein said first cans arranged in a general row, wherein said second source comprises a second can containing a supply of said reserve sliver, and wherein said second can is situated as to be generally between said row of said first cans and said pair of feed rollers.

16. A sliver feeding arrangement according to claim 1 wherein said plurality of first sources comprise a plurality of first cans containing a supply of said active slivers, wherein said first cans are arranged in a general row, wherein said second source comprises a second can containing a supply of said reserve sliver, and wherein said second can is situated as to be generally furthermost away from said pair of feed rollers as compared to said row of first cans.

17. A sliver feeding arrangement according to claim 1 wherein said second source comprises a bobbin, and further comprising bobbin drive rollers for rotating said bobbin, and motion transmitting means operatively interconnecting at least one of said bobbin drive rollers to said pair of feed rollers.

* * * * *